US006851577B2

(12) United States Patent
Kleyman et al.

(10) Patent No.: US 6,851,577 B2
(45) Date of Patent: Feb. 8, 2005

(54) DELIVERING MECHANISM FOR DISPENSER

(76) Inventors: Gennady I. Kleyman, 1209 E. 19th St. Suite 3A, Brooklyn, NY (US) 11230; Yurly D. Chernov, 2448 E. 22nd St., Brooklyn, NY (US) 11235

( * ) Notice: Subject to any disclaimer, the term of this patent is extended or adjusted under 35 U.S.C. 154(b) by 0 days.

(21) Appl. No.: 10/385,956

(22) Filed: Mar. 11, 2003

(65) Prior Publication Data

US 2004/0178221 A1 Sep. 16, 2004

(51) Int. Cl.[7] ..... B65D 35/28
(52) U.S. Cl. ..... 222/103
(58) Field of Search ..... 222/103

(56) References Cited

U.S. PATENT DOCUMENTS

| | | | | | |
|---|---|---|---|---|---|
| 1,979,105 | A | * | 10/1934 | Harnsih | 222/103 |
| 2,357,544 | A | * | 9/1944 | Prance | 222/96 |
| 2,492,533 | A | * | 12/1949 | Olsen | 222/103 |
| 2,596,310 | A | * | 5/1952 | Vita | 222/103 |
| 2,795,356 | A | * | 6/1957 | Tschumy | 222/103 |
| 2,880,911 | A | | 4/1959 | Robertson | |
| 2,880,922 | A | | 4/1959 | Robertson | |
| 3,313,455 | A | | 4/1967 | Kemmer | |
| 3,326,420 | A | | 6/1967 | Turner | |
| 3,536,234 | A | | 10/1970 | Rise | |
| 4,448,333 | A | | 5/1984 | Ferrari | |
| 4,579,254 | A | | 4/1986 | Puskarcik | |
| 4,928,851 | A | | 5/1990 | Eatherly | |
| 5,071,036 | A | | 12/1991 | Kelly et al. | |
| 5,167,348 | A | | 12/1992 | Okami et al. | |
| 5,222,629 | A | | 6/1993 | Tal | |
| 5,277,335 | A | | 1/1994 | Okami et al. | |
| 5,501,369 | A | | 3/1996 | Tal | |
| 5,657,903 | A | | 8/1997 | Roberts | |
| 5,857,593 | A | | 1/1999 | Patronaggio | |
| 6,302,298 | B1 | | 10/2001 | Chernov et al. | |

* cited by examiner

*Primary Examiner*—Philippe Derakshani
(74) *Attorney, Agent, or Firm*—Dilworth & Barrese, LLP

(57) ABSTRACT

A dispenser configured to receive a collapsible container and provided with a slider linearly guided along the collapsible container to uniformly press thereagainst to advance a substance contained in the collapsible towards and discharge it through the container's outlet port at a uniform rate.

15 Claims, 8 Drawing Sheets

DELIVERING MECHANISM FOR DISPENSER

CROSS REFERENCE TO RELATED APPLICATION

This application is based on disclosure statement No. 517198 filed on Aug. 22, 2002.

BACKGROUND OF THE INVENTION

1. Field of the Invention

This invention relates to dispensing systems. Particularly, the invention relates to dispensing systems facilitating discharging the contents of various collapsible packages such as the tubes containing toothpaste, adhesive pastes, grease paints, various creams, shampoos, some medicaments and the like.

2. Description of the Prior Art

A wide variety of devices have been suggested and provided for the purpose of holding a collapsible tube, such as a tube of toothpaste, and gradually dispensing the contents. These devices range from a simple slotted key, to ceramic rollers, to elaborate geared contraptions.

These devices generally operate with a channel receiving a tube of toothpaste or the like and provided with a means for supporting the tube so as to progressively dispense the contents of the tube. Collapsible containers or tubes typically have flat back ends and provided with an annular cross-section terminating with a relatively narrow neck, which is fitted with a screw-on cap or other such closure. When the cap is removed, the open end of the neck serves as an outlet for the product discharged from the tube for application in the ordinary course of its use. Many such tubes are made from a pliable plastic material which one can squeeze by hand to force product out. These tubes usually do not hold their deformed configuration once the externally applied pressure is released, but rather spring back to approximately their original shape and condition.

Other tubes are constructed of a light weight metal, such as an aluminum compound, for example, and these tubes often do hold their deformed configurations once the applied pressure has been released.

For those tubes which spring back to their approximate original shape, the product they contain can once again spread out in the full volume of the tube. Over time, as the contents are used up, the small amount remaining in the tube can be hard to dispense for use by the usual method of applying finger pressure.

Similarly, in cases where the tubes remain deformed, pockets of cream product may be scattered throughout the tube. Again, this unwanted, sporadic accumulation of the product to be discharged prevents the latter from being fully squeezed out of the tube, if ordinary finger pressure is used.

Some attempts have been made previously to provide mechanical devices which can apply greater force or more evenly distribute the force applied, than is possible using one's fingers only. For example, in U.S. Pat. No. 3,326,420, the tube is secured within a channel by means of its flat end and a slide progressively engages the tube to empty its contents. The structure of this patent may be disadvantaged because as the tube is compressed until a point adjacent its' conically-shaped end, a quantity of material remains trapped at that end. Such a device is generally difficult to use for further squeezing the tube to expel the last material contained in the conical end. One therefore has to insert his fingers into the device to further squeeze the remaining material out of the tube.

U.S. Pat. No. 2,880,911 attempts to overcome this drawback by providing a seat having an elongated aperture and a bent section, but the aperture does not extend through the bend. The conical end of the tube can be forced down into a recess created by the bent section and the tube emptied of its contents. However, this patent requires that one use his fingers to empty the contents and even if one were to attach a slide to the Robertson device, still, at the end where the last remaining material must be expelled, one would still have to use his fingers to accomplish the job. Accordingly, in each of the foregoing devices where an attempt has been made to minimize manipulation of the tube and to provide an automatic, attractive, economical device, both economy and mechanical operation have been frustrated by the inability to dispense the last remaining material in the tube by automatic means.

In addition to the above-noted disadvantages, the prior art dispensing arrangements had limited flexibility with regard to the number of sizes of packages that could be used in a particular device due to the fact that but a single pressure arm was provided. U.S. Pat. No. 6,302,298 commonly owned with and fully incorporated in this application discloses a squeezing mechanism wherein multiple formations on a container and a slider, which mesh with one another upon advancement of the mechanism along the container. While the squeezing mechanism performs admirably well, the necessity of forming teeth on a container limits the application of this mechanism to specifically manufactured tubes.

It is therefore desirable to provide a multi-use dispensing system capable of effectively squeezing contents of variously dimensioned and shaped flexible tubes in a simple and efficient manner.

SUMMARY OF THE INVENTION

Accordingly, it is an object of the invention to provide a dispenser improving distribution of material stored in a collapsible container.

Still another object of the present invention is to provide the dispenser configured to cooperate with a collapsible container so as to avoid pockets of accumulated material left behind during displacement of the dispenser along the container.

A further object of the invention is to provide the dispenser operative to discharge material from the collapsible container at a uniform rate.

To attain these objects, the inventive dispenser has a frame and a slider engaging the frame so that the slider is displaceable relative to a collapsible container received in the frame while applying a uniform pressure to the periphery of the container sufficient to discharge material from the container.

One of the advantages of the inventive dispenser is that it can be used with a variety of differently shaped and sized collapsible containers. Still another advantage of the inventive container is that the slider is provided with a configuration and dimension ensuring uniform contact with the outer periphery of the collapsible container during displacement of the slider. Further, due to the uniform distribution of pressing or squeezing forces imposed by the slider upon the collapsible container, a rate of distribution, at which material is discharged, is substantially constant. This, in turn, makes the inventive assembly usable in a variety of industries, in which a uniform volume per unit of time is essential to a manufacturing process.

In accordance with another aspect of the invention, the dispenser is removably attached to a container. Since the inventive dispenser is configured for use with differently shaped and dimensioned collapsible containers, its multiple use provides the users with economical advantages.

Furthermore, a ratchet mechanism provided on the inventive assembly can help handicapped users in dosing the squeezable material in accordance with either prescribed dosage or desired dosage. The users can sense a desired dosage as a result of sound or increase in resistance to the displacement of the slider along the frame.

BRIEF DESCRIPTION OF THE DRAWINGS

The above and other objects, features and advantages will become more readily apparent from the detailed description accompanied with the following drawings, in which.

DETAILED DESCRIPTION OF THE PREFERRED EMBODIMENT

Figure 1:
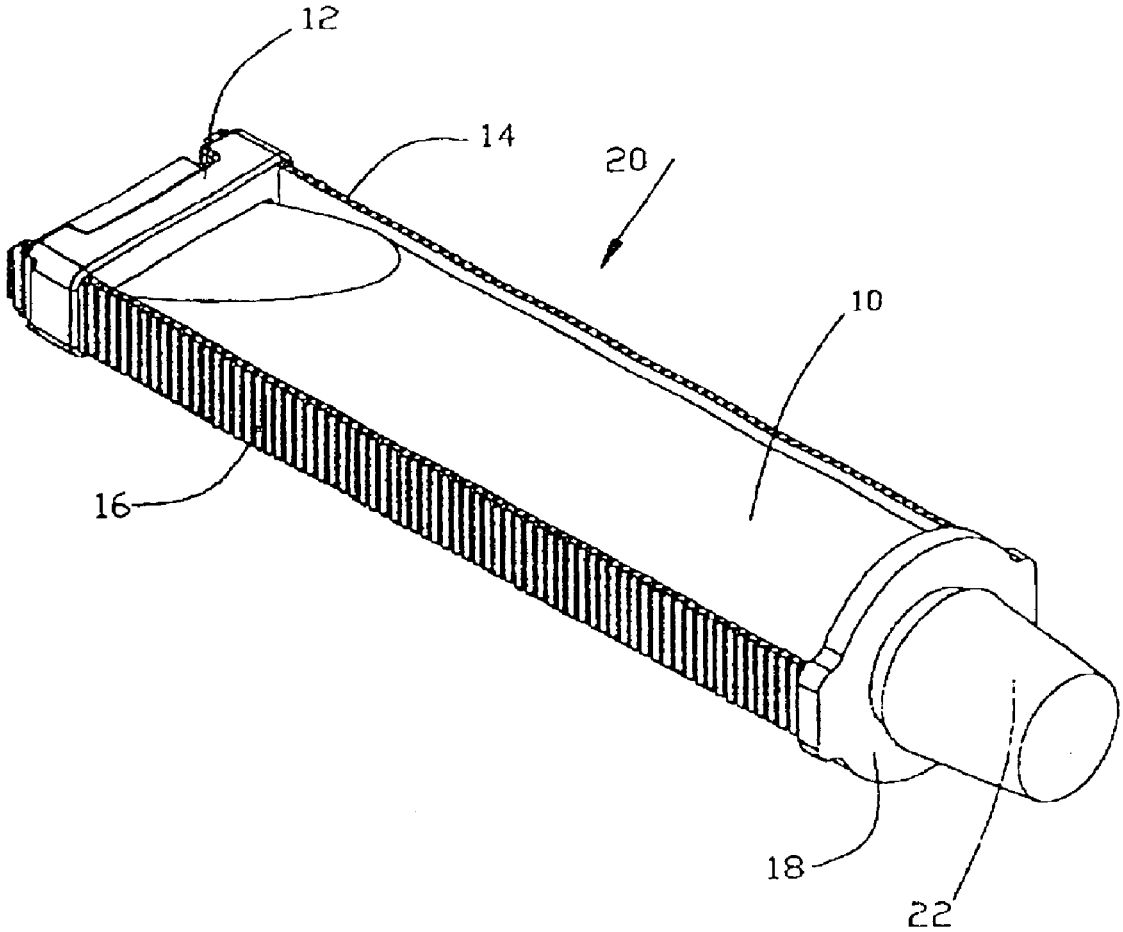
FIG. 1 is an isometric view of the inventive dispensing system.
Figure 2:
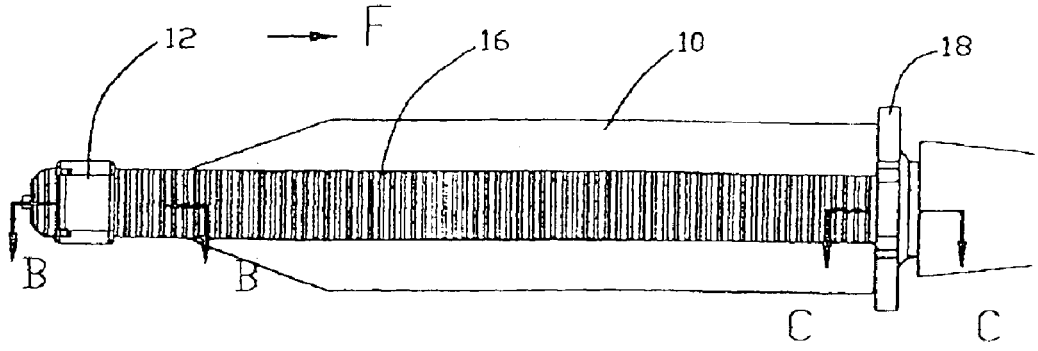
FIG. 2 is a side elevational view of the inventive dispensing system receiving a collapsible container.
Figure 3:
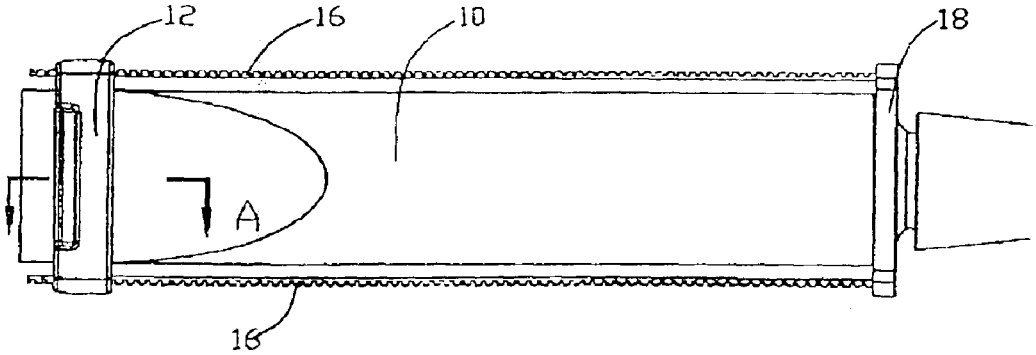
FIG. 3 is a top side of the inventive system as shown in FIG. 2.
Figure 4:
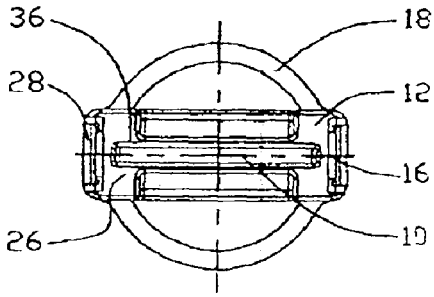
FIG. 4 is a rear side of the inventive system shown in FIG. 1.
Figure 5:
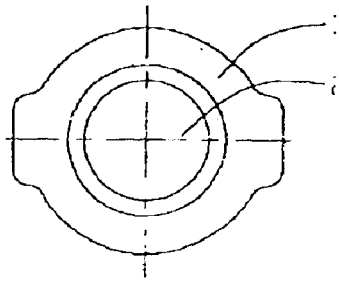
FIG. 5 is a front view of the inventive system illustrated in FIG. 1.
Figure 6:
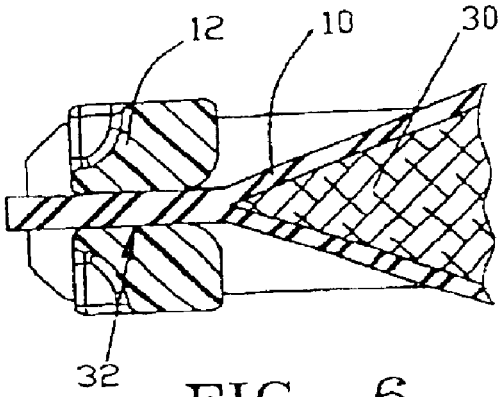
FIG. 6 is a sectional view of a slider of the inventive system taken along lines B—B in FIG. 2.
Figure 7:
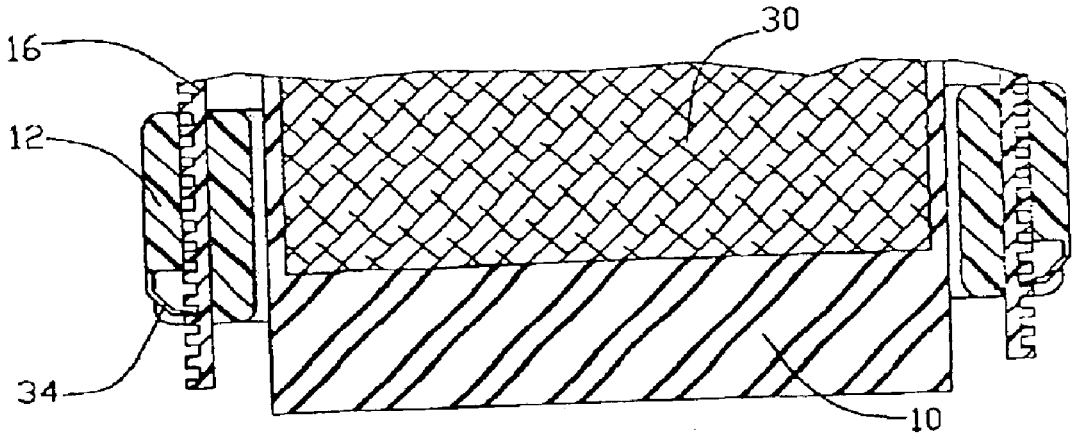
FIG. 7 is a sectional view of the inventive system illustrating a guide assembly illustrated along an upstream end of slider path and taken along lines C—C in FIG. 2.
Figure 8:
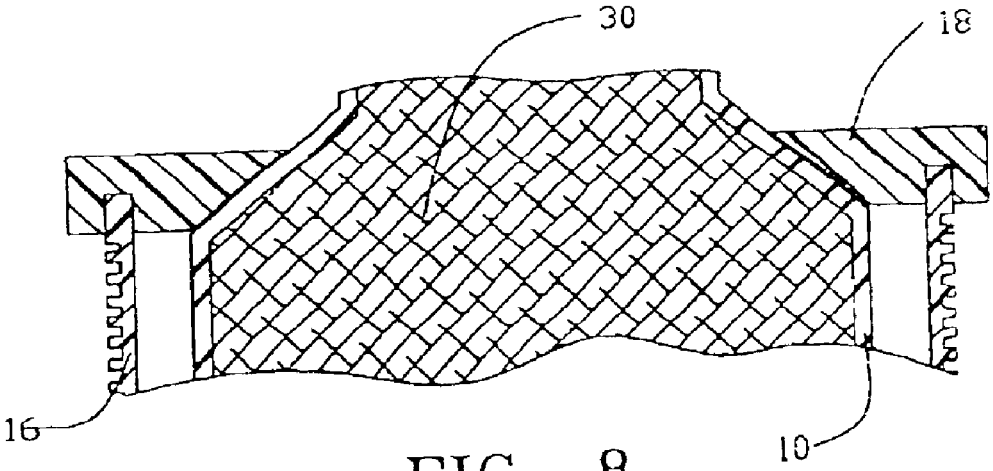
FIG. 8 is a sectional view similar to the one of FIG. 7, but taken along the upstream end of the slider path.

Referring to FIGS. 1–8, a dispenser system includes a frame 20 adjustable to receive variously dimensioned collapsible containers 10 and configured to guide a slider 12 along the container 10 to dispense a contained substance at a uniform rate. The frame 20 is guided over the container 10 insertable through an opening 24 (FIG. 5) of a detachable harness 18 until the bottom of the container extends through an opening 26 (FIG. 4) of the slider 12. Accordingly, once the bottom of the container 10 is received in the opening 26, the harness 18 is mounted on the front end of the frame 20 to prevent displacement of the container relative to the frame 20.

The slider 12 is so configured that, while being displaced along the frame 20 towards the container's outlet covered by a removable top 22 (FIG. 1), the substance 30 (FIG. 6) leaves the outlet at a uniform rate. Structurally, the slider 12 is provided with guiding surfaces 32 (FIG. 6) coextending with one another and providing a uniform pressure against the opposite faces of the container 10, which causes the substance 30 to uniformly advance towards the container's outlet. To eliminate formation of pockets of accumulated substance 30 in the container during displacement of the slider 12 towards the outlet, the opening 26 is so configured that its peripheral edge 36 (FIG. 4) is in sliding contact with and extends complementary to the periphery of the container 10.

Along its path toward the front end of the container 10, the slider 12 experiences a greater resistance of the substance 30 that ordinarily would make the slider 12 to slightly back up and assume a misaligned position with respect to the container 10. Accordingly, discontinuous contact between the slider and the container during further displacement of the slider 12 may detrimentally affect the distribution of the substance. To avoid it, the frame 20 includes a pair of toothed tracks 16 (FIGS. 7, 9), which extend through recesses 28 (FIG. 4) formed in the slider 12 on opposite sides of the opening 26. The toothed tracks 16 form a part of ratcheting mechanism, which also includes a flexible arm 34 engaging the detents of the toothed tracks 16 so that displacement of the slider 12 backwards is prevented. Alternatively, the sides of the slider 12, opposing the tracks 16, can be formed with arrays of teeth meshing with the teeth of the tracks 16 and configured to allow displacement of the slider only towards the outlet region of the container.

In use, the uniform pressure generated by the displaceable slider 12 and distributed all around the periphery of the container 10 causes the substance 30 to uniformly advance towards the outlet region of the container 10, as illustrated in FIGS. 6–9.

Figure 9:
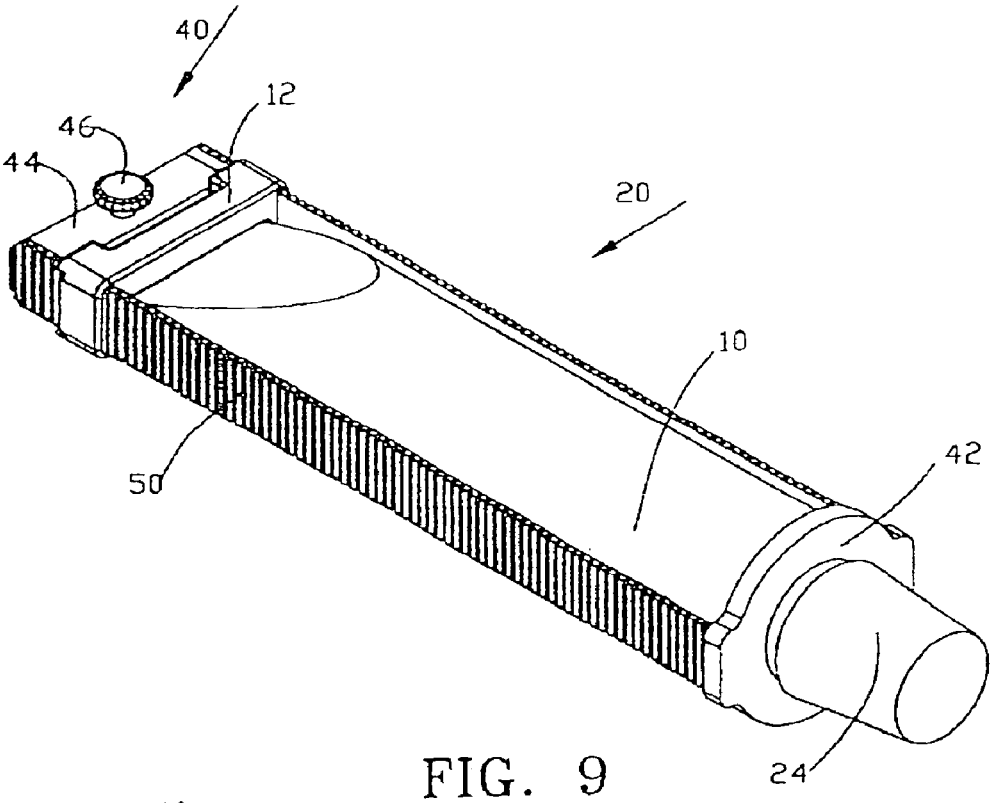
FIG. 9 is an isometric view of another embodiment of the inventive dispenser system.
Figure 10:
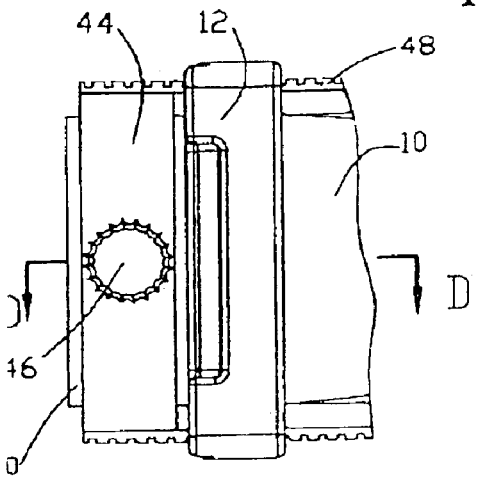
FIG. 10 is an enlarged view of a stopper unit of the inventive dispenser system.
Figure 11:
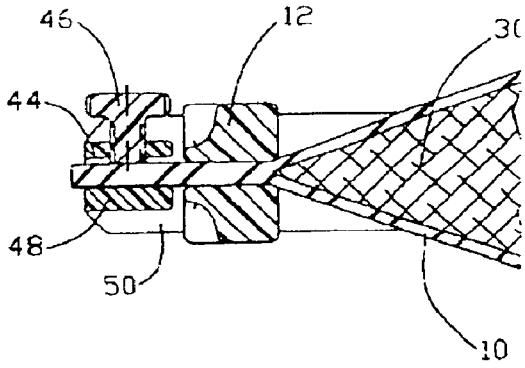
FIG. 11 is a sectional view taken along lines D—D of FIG. 10.

Referring to FIGS. 9–11, the inventive structure is configured to facilitate its use by allowing the user to discharge material from the container 10 with only one hand. Principally, the inventive dispensing system has the same main elements as the structure discussed above and includes a pair of toothed tracks 50 frictionally engaging the slider 12, which is configured to slide only in one direction. Typically, the user would use one of his/her hands to firmly hold the upstream of the container as the other hand applies a force sufficient to displace the slider 12. However, as may be the case with a handicapped person, only one arm can be available to manipulate the inventive system.

To allow the handicapped user to conveniently operate the inventive system, a clamp 40 is configured to surround the periphery of the container 10 along a substance-free region and to provide the user with a convenient support. The clamp 40 has a cartridge 44, displaceable within the frame 20, and a screw 46, which is hand-actuated to move towards and engage the periphery of the container 10 in a position immediately upstream from the slider 12 along the entire path of the latter along the container. In use, thus, the user can operate the slider 12 with a single finger while having the rest of his/her arm on the clamp. Thus, the clamp 40 functions both as a hand support and, further, as a barrier preventing a small portion of substance, which may be unaffected by the slider 12, from spreading backwards.

The inventive system, as illustrated in FIGS. 1–11, allows displacement of the slider 12 only in one direction. In contrast, FIGS. 12–13 illustrate another embodiment of the inventive system configured for multi-use purposes.

Similarly to the previously described embodiments, a system 60 includes a pair of toothed tracks 62 and a slider 64 configured to receive the bottom of the container 10. The system 60 is provided with a toothed wheel 70 rigidly attached to the slider 64 by a support structure 72 and having peripheral teeth, which mesh with the tracks 62.

To prevent the slider 12 from displacing backwards as the resistance of the substance increases along the slider's path, a flexible arm 66 meshes with the toothed wheel 70 so that rotation of the wheel is allowed only in one direction. Displacement in one direction can be accomplished by appropriately shaping engaging surfaces of the free end of the flexible arm and of the detents, as known and used in a ratcheting mechanism.

Figure 12:
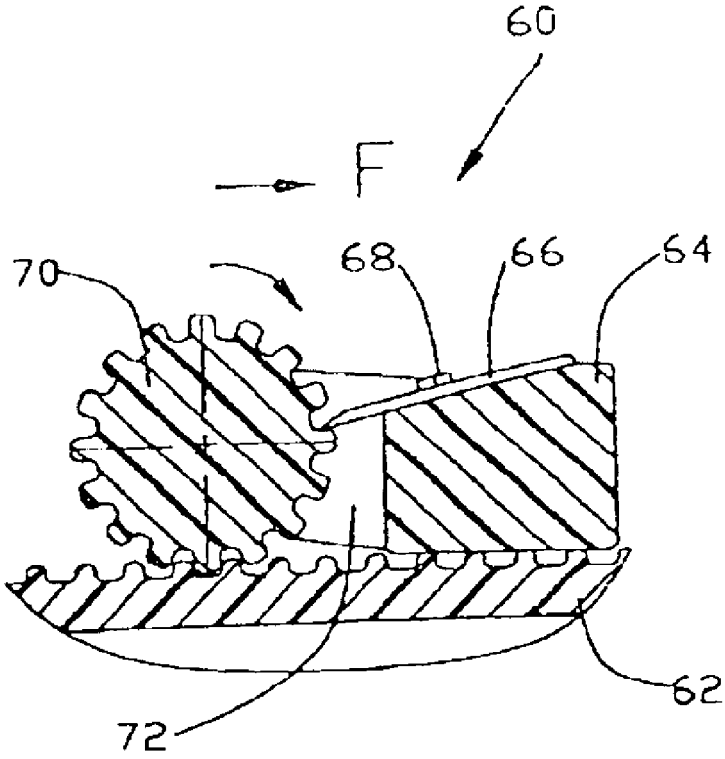
FIG. 12 is a sectional view of guide mechanism shown in the locked position of the stopper unit.
Figure 13:
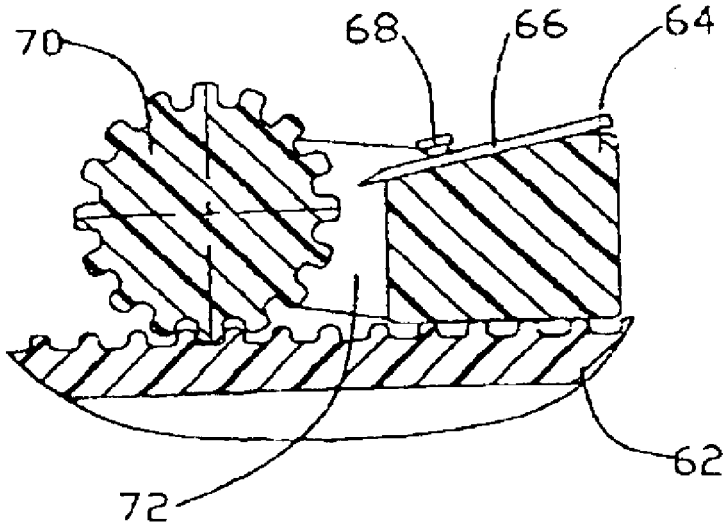
FIG. 13 is a view similar to the one shown in FIG. 12, but shown in the unlocked position of the stopper unit.

If it is desirable to displace the slider 64 backwards toward the bottom of the container 10 or to use the system with another container, the arm 66 is either rotated or linearly displaced from its operative position, as shown in FIG. 12, to a rest position of FIG. 13. A pin 68, which can be either threaded or have such a shape that the arm 66 and the body of the slider 64 are fixedly engaged, is loosened allowing the arm 66 to slide relative to the pin away from the toothed wheel to the rest position. Accordingly, the slider/wheel assembly can move backwards along the tracks and disengage therefrom. During a repeated use, the slider/wheel assembly can be easily mounted on the tracks 62 for further use with another container.

Figure 14:
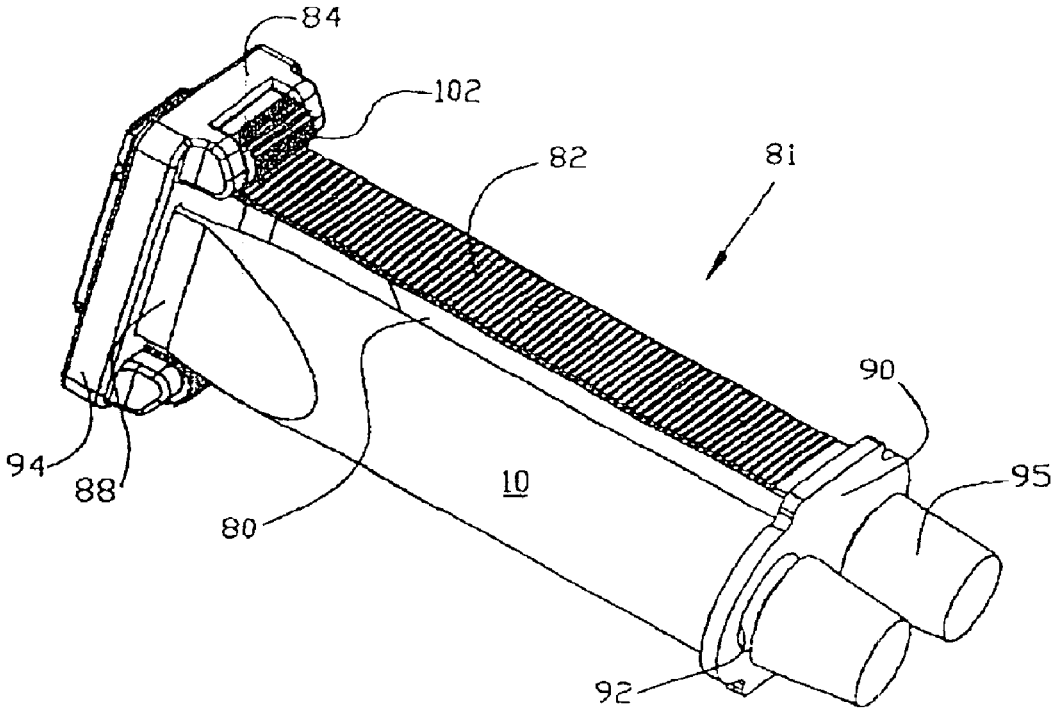
FIG. 14 is an isometric view of still another embodiments of the inventive dispenser system.
Figure 15:
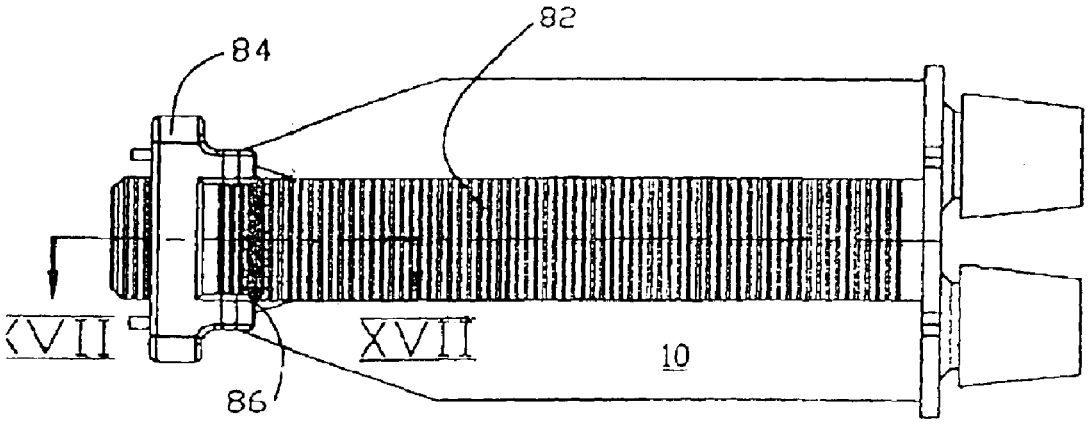
FIG. 15 a side elevational view of the dispenser assembly of FIG. 14.
Figure 16:
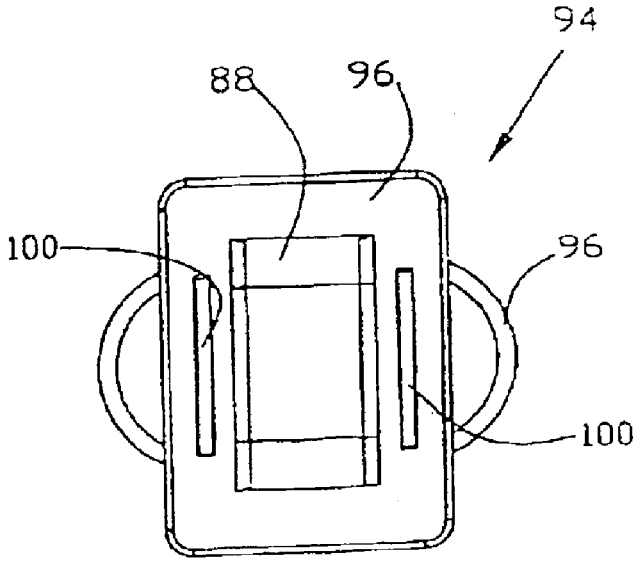
FIG. 16 a bottom view of the dispenser assembly of FIG. 14.
Figure 17:
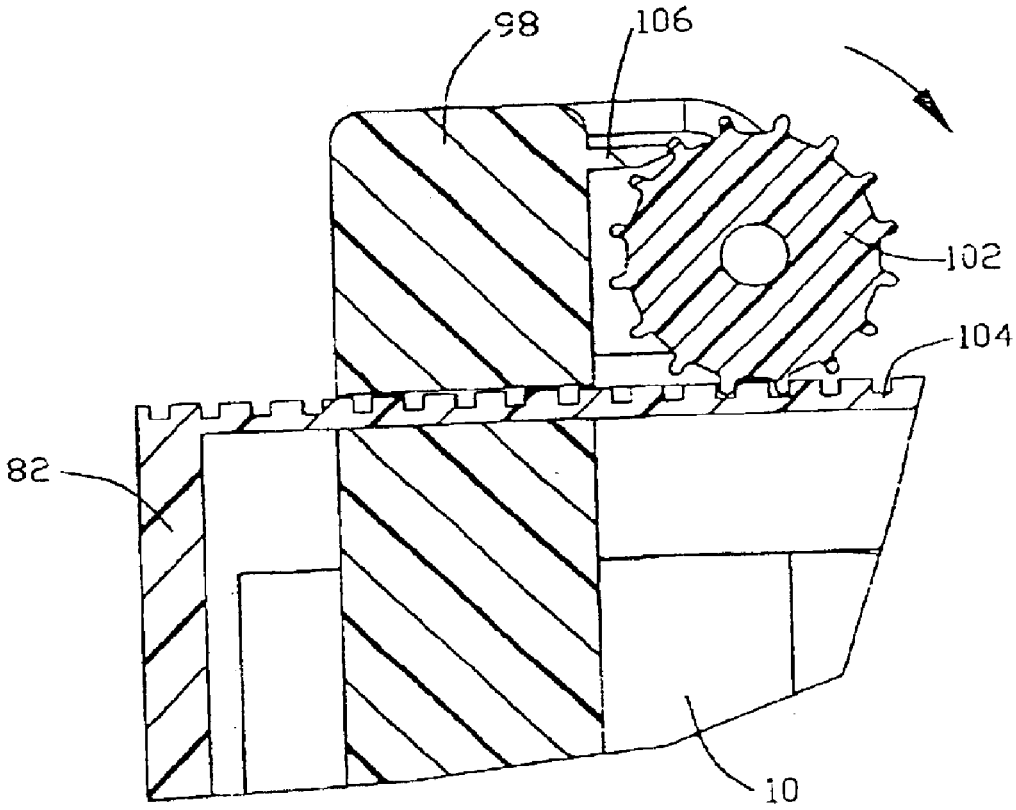
FIG. 17 is an enlarged partial section XVII—XVII, as illustrated in FIG. 14

Turning to FIGS. 14–17, the slight modification of the dispenser assembly, as shown in FIGS. 1–13, allows the user to utilize multiple containers simultaneously. In particular, the dispenser assembly 81 includes a frame 80 configured to receive two containers 10 mounted in the frame so that their bottoms 88 extend parallel to one another, as shown in FIG. 14. Similarly to the previously discussed embodiments, the assembly 81 includes a slider 84 mounted on rear ends of parallel tracks 82, which are spaced apart at a distance sufficient to receive the containers 10. A harness 90 coupling the front ends of the tracks 82 has a pair of openings 92 configured to receive front ends of the containers 10 with caps 95 temporarily taken off to allow insertion of the front ends of the containers 10 into the openings 92. To prevent accidental disengagement between the containers 10 and the frame 80, after insertion of the front ends of the container into the holes, caps 95, dimensioned to be slightly larger than the openings 92, are screwed in onto the front ends.

The slider 84 has a generally U-shaped bracket 94 configured of a bottom 96, which receives the bottoms of the containers 10 in spaced apart slits 100 (FIG. 16), and sides 98 (FIG. 17), which support two spaced toothed wheels 102. In practice, the user applies a thrust to the bracket 94 sufficient to advance the slider 84 relative to the tracks 82 causing the toothed wheels 102 and indentations 104 formed on the tracks 82 (FIG. 17) to interengage during displacement of the slider toward the tracks' front ends. Consonant with the operation of the ratcheting mechanism, reverse displacement of the slider is prevented due to the geometry of tongue 106 (FIG. 17) provided on the bracket 94 and configured to allow the rotation of the wheel 102 only in one clockwise direction.

Figure 18:
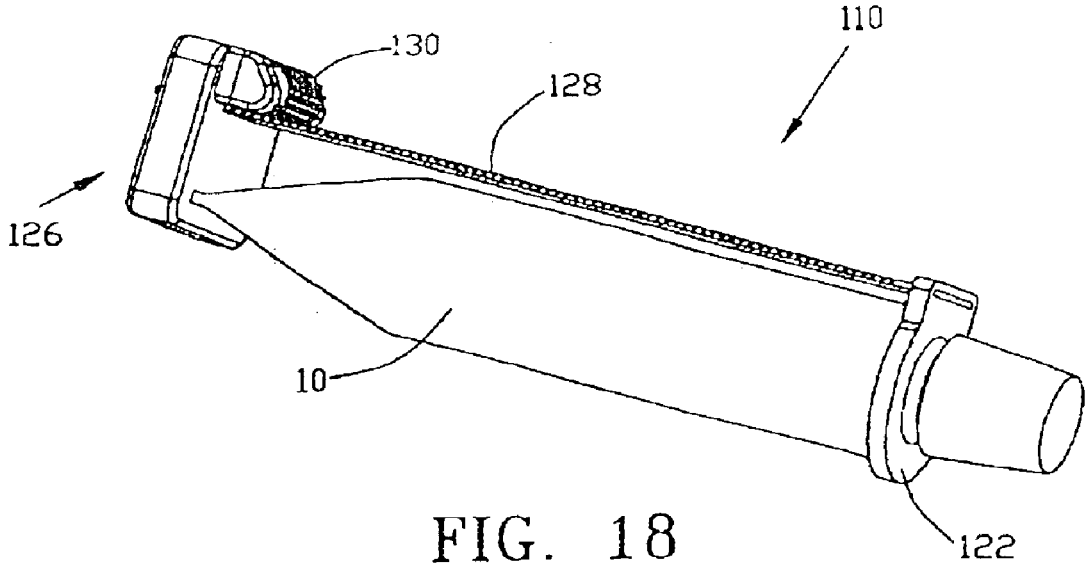
FIG. 18 is an isometric view of yet another embodiment of the inventive dispenser assembly.
Figure 19:
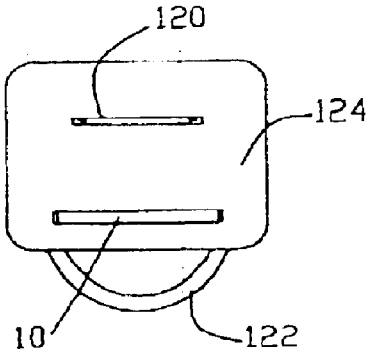
FIG. 19 is a left side view of the dispenser assembly shown in FIG. 18.
Figure 20:
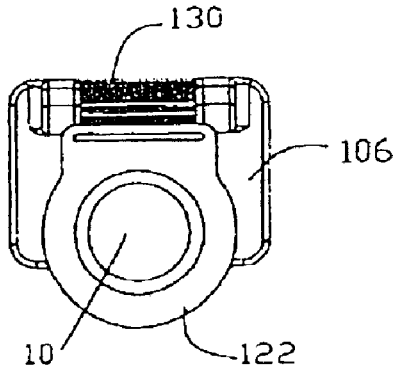
FIG. 20 and a right side view of the dispenser assembly shown in FIG. 18.

FIG. 18 illustrates the inventive assembly 110 configured similarly to the embodiment of FIGS. 14–17, but dimensioned to operate with the single container 10. Slits 120 formed in the bottom 124 (FIG. 19) of a slider 126 are configured to provide smooth, uniform flow of material to be dispensed from the container(s) 10, as the slider 126 advances frontward in response to activation of a toothed wheel 130. The slider 126 is positioned so that the user is able to move it along a track 128 toward a harness 122. Alternatively, the slider can be configured in accordance with the structure shown in FIGS. 12 and 13.

The above description should not be construed as limiting, but merely as exemplifications of preferred embodiments. Those skilled in the art will envision other modifications within the scope and spirit of the present disclosure.

What is claimed is:

1. A delivering mechanism for displacing a substance from at least one collapsible container, comprising a frame configured to receive the at least one collapsible container and a slider operative to move along the frame and having a recess, the recess being shaped and uniformly dimensioned to surround and uniformly press against a periphery of the at least one collapsible container during displacement of the slider between opposite ends of the at least one collapsible container, wherein the frame includes at least one track extending between front and rear ends, and a harness removably mounted on the front end of the at least one track to prevent displacement of the collapsible container relative to the frame, wherein the slider is displaceable along the at least one track from the rear end towards the front end in response to an external force.

2. The delivering mechanism according to claim 1, wherein the recess is dimensioned to receive a bottom of the collapsible container and has a surface conforming to and juxtaposed with the periphery of the collapsible container so as to peripherally contact the periphery while uniformly pressing thereagainst.

3. The delivering mechanism according to claim 1, wherein the slider has at least one side receiving the at least one track so that the slider and the at least one track are displaced relative to one another.

4. The delivering mechanism according to claim 3, wherein the at least one side has a respective opening dimensioned to be traversed by the at least one track.

5. The delivering mechanism according to claim 4, wherein the at least one track is patterned to have spaced apart detents, the slider being provided with a flexible trailing arm attached to the slider and slidingly or rotatably coupled with the detents as the slider moves along the frame.

6. The delivering mechanism according to claim 5, wherein a free end of the flexible arm sequentially engages the detents and is configured to prevent displacement of the slider in a rearward direction upon engagement with the detents of the at least one track.

7. The delivering mechanism according to claim 5, further comprising an additional track identical to the at least one track and spaced therefrom, and spaced apart toothed wheels each coupled to the slider and meshing with the detents of a respective track so as to move therealong with the slider in response to the application of the external force.

8. The delivering mechanism according to claim 7, wherein the flexible arm is displaceably mounted on the slider to move between a rest position, in which a free end of the flexible arm is spaced from a periphery of at least one of the toothed wheels so as to allow displacement of the slider in opposite forward and rearward directions, and an operative position, in which the free end engages the periphery of the at least one toothed wheel to allow advancement of the slider along the track only in a frontward direction.

9. The delivering mechanism of claim 5, further comprising a clamp mounted on the at least one track upstream from the slider and provided with a fastener selectively coupling the clamp with the collapsible container to provide a hand support and to prevent displacement of the substance rearwards as the slider is displaced frontward.

10. The delivering mechanism of claim 7, wherein the slider includes a bottom provided with a slit receiving a bottom of the at least one collapsible container and at least one flank extending from the bottom, at least one of the toothed wheels being rotatably supported on the flank and configured to engage the at least one track.

11. The delivering mechanism of claim 10, wherein the at least one flank has a pair of sides spanned by a respective toothed wheel and a bottom provided with a tongue engaging the toothed wheel and configured to allow rotation of the toothed wheel in one direction and to prevent the rotation of the wheel in the opposite direction.

12. The delivering mechanism of claim 10, wherein the at least one and the additional track of the frame are spaced apart to receive the at least one collapsible container and a second collapsible container, further comprising a bracket having a U-shape and configured to support a pair of toothed wheels, each slidingly engaging a respective track as the bracket is displaced towards the harness.

13. A delivering mechanism for displacing a substance from at least one collapsible container, comprising:

a frame configured to receive the at least one collapsible container; and a slider, the slider being provided with at least one toothed track extending along the at least one collapsible container, a bracket mounted on the at least one toothed track, and a toothed wheel displaceably fixed to the bracket and configured to rotationally engage the at least one toothed track to provide displacement of the bracket relative to the container, the bracket having a slit configured to receive and uniformly press against a periphery of the at least one collapsible container to provide smooth, uniform flow of the substance therefrom during the displacement of the slider.

14. The mechanism of claim 13, wherein the slider further comprises a tongue coupled to the bracket and displaceable between a first position, wherein the tongue engages the toothed wheel to allow rotation thereof in one rotational direction and to prevent rotation of the wheel in an opposite rotational direction, and a second position wherein the toothed wheel rotates in the opposite rotational direction to provide disengagement of the slider from the at least one container.

15. A mechanism for delivering a substance from at least one collapsible container, comprising:

a frame configured to receive the at least one collapsible container and having at least one toothed track extending along the at least one collapsible container;

a bracket having a slit configured to receive a periphery of the at least one collapsible container and frictionally engage the at least one toothed track so that the bracket moves along the at least one toothed track only in one direction in response to a pushing force to provide smooth, uniform flow of the substance therefrom; and a slider operative to move along the frame and having opposite sides each receiving a respective track so that the slider is displaced relative thereto from a rear end towards a front end of the at least one collapsible container in response to the pushing force, the slider having an inner recess provided with a constant cross-section dimensioned to surround and uniformly press against a periphery of the at least one collapsible container during displacement of the slider between the rear and front ends.

* * * * *